United States Patent [19]

Fenton

[11] 4,417,862

[45] Nov. 29, 1983

[54] ROTARY MOTOR WITH MULTILOBED ROTOR AND ORBITING COUPLING MEANS

[76] Inventor: John W. Fenton, 1258 Aalapapa, Kailua, Hi. 96734

[21] Appl. No.: 298,925

[22] Filed: Sep. 3, 1981

[51] Int. Cl.[3] ..... F01C 1/22; F01C 17/02

[52] U.S. Cl. ..... 418/54; 418/61 A

[58] Field of Search ..... 418/54, 61 A, 61 B

[56] References Cited

U.S. PATENT DOCUMENTS

| | | | |
|---|---|---|---|
| 3,134,337 | 5/1964 | Paschke | 418/61 A |
| 3,173,406 | 3/1965 | Campos | 418/61 A |
| 3,205,872 | 9/1965 | Pomasanow | 418/61 A |
| 3,216,405 | 11/1965 | Jungbluth | 418/61 A |
| 3,441,007 | 4/1969 | Kwaak | 418/61 B |
| 3,716,314 | 2/1973 | Takahashi | 418/150 |
| 3,799,705 | 3/1974 | Gunthard | 418/61 A |
| 3,944,378 | 3/1976 | McDermott | 418/61 B |
| 3,970,050 | 7/1976 | Hoadley | 418/61 A |
| 4,108,137 | 8/1978 | Yamamoto et al. | 123/242 |

FOREIGN PATENT DOCUMENTS

| | | | |
|---|---|---|---|
| 1125715 | 3/1962 | Fed. Rep. of Germany | 418/61 A |
| 2378947 | 9/1978 | France | 418/61 A |

*Primary Examiner*—John J. Vrablik

*Attorney, Agent, or Firm*—Dunlap & Codding

[57] ABSTRACT

A rotary motor comprising a housing having an internal chamber formed therein. Energy input means power orbital movement of a rotor about the internal chamber and simultaneously power rotational movement of the rotor about a first rotational axis. An orbital coupling assembly causes the movement of the rotor to drivingly power rotation of an output shaft. The rotor has three lobes which define the vertices of an equilateral triangle having a circumscribed circle of radius R. The equations for the internal chamber, with the output shaft defining the z-axis, are:

$$x=(A+B)\cos\alpha+R\cos(\alpha/3)$$

$$y=(A-B)\sin\alpha+R\sin(\alpha/3)$$

where A, B and R are arbitrary constants and where $\alpha$ is an angle ranging between 0 and $6\pi$ radians.

13 Claims, 16 Drawing Figures

ROTARY MOTOR WITH MULTILOBED ROTOR AND ORBITING COUPLING MEANS

FIELD OF THE INVENTION

The present invention relates generally to motors having a rotatable rotor for driving rotation of a shaft.

DETAILED DESCRIPTION OF THE PREFERRED EMBODIMENT

Figure 1:
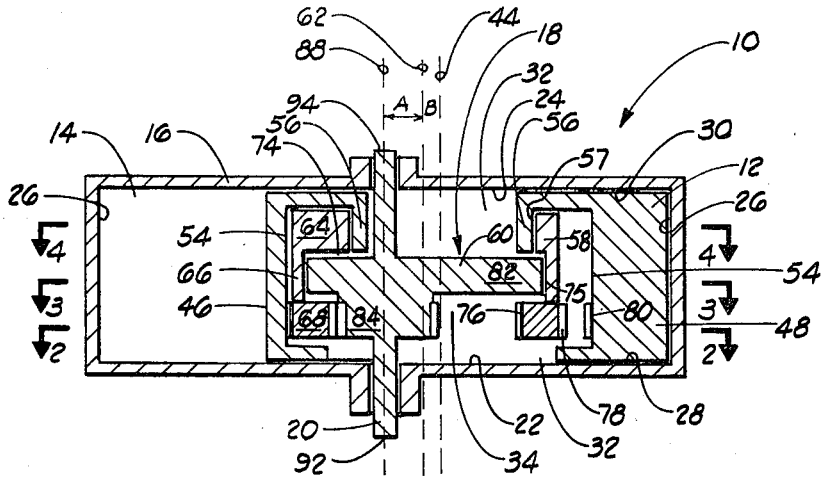
FIG. 1 is a cross-sectional view of the rotary motor of the present invention.

With reference to FIG. 1, the rotary motor of the present invention, generally designated by reference numeral 10, comprises a rotor 12 supported in an internal chamber 14 formed in a housing 16. An energy input assembly (not shown in FIG. 1) is provided to power orbital movement of the rotor 12 around the internal chamber 14, thereby causing the centroid of the rotor 12 to follow an oval-shaped path. An orbital coupling assembly 18 is provided to drive rotational movement of a fixed output shaft 20, in response the orbital movement of the rotor 12. The construction and operation of those components of the rotary motor 10 will now be described in greater detail.

With continued reference to FIG. 1, the internal chamber 14 of the housing is defined by a flat front wall 22 and a parallel back wall 24, between which extends a peripheral wall 26. The peripheral wall 26 defines the characteristic cross-sectional contour of the internal chamber 14, which will be described in detail hereafter. Disposed within the internal chamber 14, and supported by the housing 16, is the rotor 12.

The rotor 12 features a first face surface 28 and a parallel second face surface 30 which clearingly engage, respectively, the front wall 22 and back wall 24 of the housing 16. The first face surface 28 and the second face surface 30 are each interrupted by a central aperture 32, both of which open to an interior cavity 34. Supported by the rotor 12 within the interior cavity 34 is the orbital coupling assembly 18. The construction of the orbital coupling assembly 18, and its disposition within the interior cavity 34 of the rotor 12, will be detailed later in this disclosure.

As best shown in semi-schematic cross-sectional view of FIGS. 6 through 12, the rotor 12 is characterized by three lobes, designated as the first lobe 36, the second lobe 38 and the third lobe 40. The three lobe extremities define the vertices of an equilateral triangle (not shown) having a circumscribed circle (not shown) of radius R, where R is a selected constant. Thus, the centroid of this equilateral triangle, hereinafter referred to as the rotor centroid 42, is disposed at a distance R from the extremity of each of the lobes. Extending through the rotor centroid 42 and disposed orthogonally to the first and second face surfaces 28 and 30, is a first rotational axis 44, shown in FIG. 1.

As shown in FIG. 1, interconnecting the first and second face surfaces 28 and 30 of the rotor 12, and extending between the first and second lobes 36 and 38 thereof, is a first side surface 46. In like manner, the rotor 12 features a second side surface 48 which interconnects the first and second face surfaces 28 and 30 and extends between the second and third lobes 38 and 40; a third side surface 49 (shown in FIGS. 6 through 12) interconnects the first and second face surfaces 28 and 30, and extends between the third and first lobes 40 and 36 of the rotor 12. In the Figures, the side surfaces are shown as arcuate and convex in cross-section.

Figure 15:
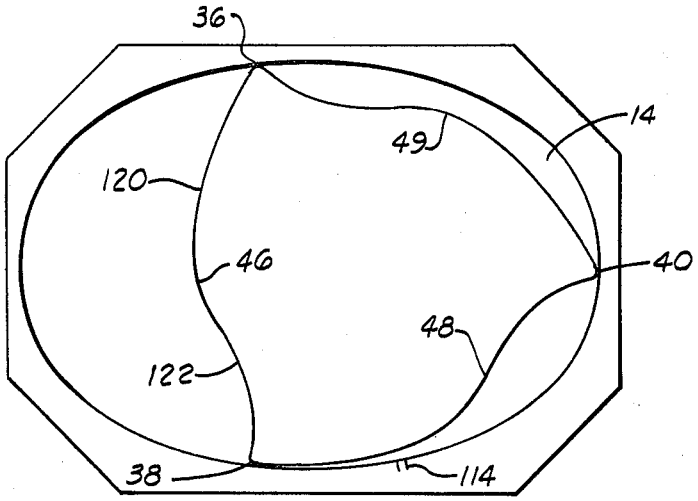
FIG. 15 is a semi-schematic, cross-sectional view of the rotary motor of the present invention, showing another type of rotor shape.

In an alternative embodiment, shown in FIG. 15, the side surfaces may be configured as follows. Adjacent the first lobe 36, the first side surface consists of a convex section 120 which extends in a counterclockwise direction (the same direction as the direction of rotation of the rotor 12, as will be described hereafter) toward the second lobe 38. Adjacent the second lobe 38 the first side surface consists of a concave section 122 shorter than the convex section 120 and having a smaller radius of curvature than the convex section 120. The profile of the first side surface 46 is invariant in profile between the first and second face surfaces 28 and 30.

In the alternative embodiment, the second side surface 48 extends from the second lobe 38 to the third lobe 40 in a manner identical to the extension of the first side surface 46 from the first lobe 36 to the second lobe 38. Likewise, the third side surface 49 extends from the third lobe 40 to the first lobe 36 in a manner identical to the extension of the first side surface 46 from the first lobe 36 to the second lobe 38.

Figure 2:
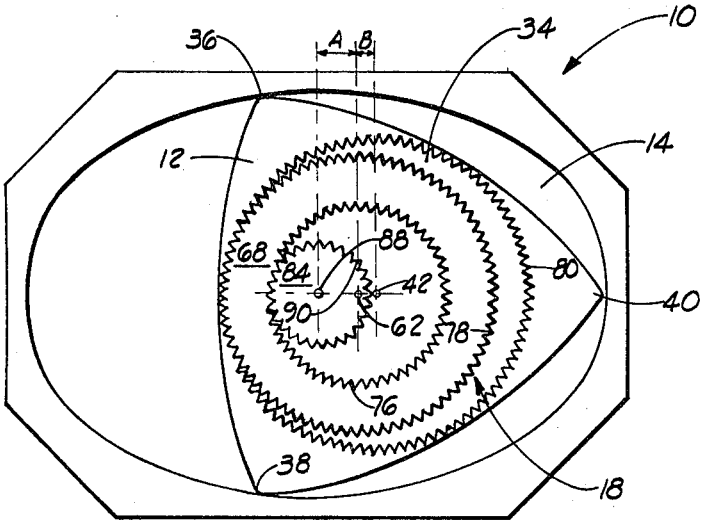
FIG. 2 is a cross-sectional view taken along the line 2—2 of FIG. 1.
Figure 3:
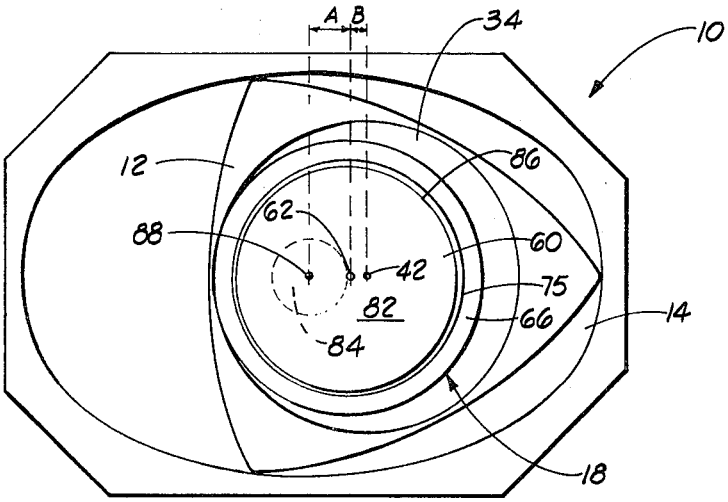
FIG. 3 is a cross-sectional view of the rotary motor taken along the line 3—3 of FIG. 1.
Figure 4:
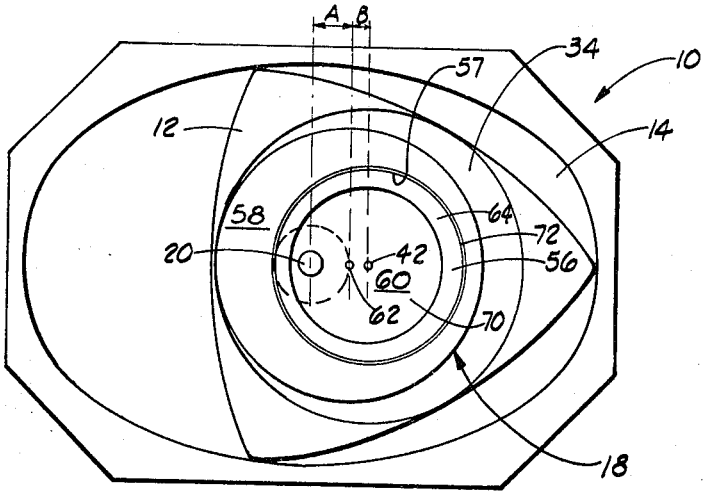
FIG. 4 is a cross-sectional view of the rotary motor taken along the line 4—4 of FIG. 1.

With reference to FIG. 1, the interior cavity of the rotor 12 is of fixed, circular cross-section, as shown in FIGS. 2, 3 and 4, and is defined by an internal rotor wall 54 axially symmetric about the first rotational axis 44. Extending into the interior cavity 12 from the second face surface is an annular flange section 56, shown in FIG. 1. The flange section 56 is characterized by a converter engagement surface 57, to be discussed hereafter.

With continued reference to FIG. 1, the orbital coupling assembly 18 is disposed within the internal cavity 34 of the rotor 12, and comprises a circular converter member 58 and a rotary converter member 60. The circular converter member 58 is of cylindrical cross-section, and is symmetric about a third rotational axis 62. The third rotational axis 62 is parallel to the first rotational axis 44, and is spaced apart therefrom by a distance B, where B is a selected constant.

The circular converter member 60 is characterized by a flange-engaging section 64, (best shown in the cross-sectional view of FIG. 4), and an integral central section 66 (best shown in the cross-sectional view of FIG. 3). Further comprising the circular converter member 60 is a non-integral gear section 68 (best shown in FIG. 2) which is engaged with the central section 66 in a manner to be described hereafter.

With reference to FIG. 4, the flange-engaging section 64 of the circular converter member 58 features an eccentric aperture 70, circular in shape, which is symmetric about the first rotational axis 44 and is therefore offset from the center of symmetry of the flange-engaging section 64 by a distance B. The eccentric aperture 70 is so sized so that the flange-engaging section 64 is in peripheral contact with the converter engagement surface 57 of the flange section 56 of the rotor 12. A bearing 72 is disposed at the area of contact between the flange-engaging section 64 and the flange section 56, so as to maintain the two sections in sliding contact.

Turning to FIG. 1, the central section 66 of the circular converter member 58 is characterized by a central section cavity 74, coaxial with the third rotational axis 62 and having a converter engagement surface 75. The rotary converter member 60 is received within this central section cavity 74, in a manner to be described hereafter.

Turning now to FIG. 2, the gear section 68 of the circular converter member 58 is an annular-shaped member having a circular, internal gear track 76 and a coaxial circular external gear track 78. Both gear tracks 76 and 78 are symmetrical about the third rotational axis 62. The gear section 68 non-integrally contacts the central section 66 so that the respective sections are independently rotatable about the third rotational axis 62.

As best shown in FIGS. 1 and 2, the external gear track 78 of the gear section 68 is tangentially engaged with a circular rotor gear track 80 which extends around the periphery of the internal rotor wall 54. The internal gear track 76 is engaged with the rotary converter member 60 in a manner to be described hereafter. The various gear ratios involved will likewise be described later in this disclosure.

Referring to FIG. 1, the rotary converter member 60 comprises an eccentric section 82 and a concentric section 84. The eccentric section 82, best shown in FIG. 3, comprises a cylindrical member, symmetrical about the third rotational axis 62. The eccentric section 82 is received within the central section cavity 74 of the circular converter member 58, as best shown in FIG. 1; the converter engagement surface 75 of the central section 66 of the circular converter member 58 is maintained in sliding engagement with the eccentric section 82 by means of a bearing 86, shown in FIG. 3.

As best shown in FIGS. 1 and 2, the concentric section 84 of the rotary converter member 60 is integral with the eccentric section 82 and comprises a cylindrical member symmetrical about a second rotational axis 88. The second rotational axis is parallel to the first rotational axis 44 and third rotational axis 62, and is spaced from the third rotational axis 62 by a distance A, where A is a selected constant.

With continued reference to FIG. 2, the concentric section 84 comprises circular external gear track 90, coaxial with the second rotational axis and tangentially engaged with the internal gear track 76 of the circular converter member 58. The applicable gear ratios for these gear tracks will be described later in this disclosure.

As best shown in FIGS. 1 and 4, the output shaft 20 is integral with the concentric section 84 of the rotary converter member 60 and is symmetrical with, and rotatable about, the second rotational axis 88. The output shaft 20 comprises a first section 92 and a second section 94. The first section 92 clearingly extends through an aperture in the front wall 22 and the second section 94 clearingly extends through an aperture in the back wall 24 of the housing 16. Bearings (not shown) are provided in each aperture in order to slidingly support the sections of the output shaft 20.

Because the position of the output shaft 20 is fixed by the housing 16, and because the rotary converter member 60 is integral with the output shaft 20, the eccentric section 82 of the rotary converter member 20 is free only to rotate about the second rotational axis 88, which is the rotational axis of the output shaft 20. Because the eccentric section 82 is received symmetrically within the circular converter member 58, at the central section cavity 74 thereof, this constraint on the motion of the eccentric section 82 likewise constrains the circular converter member 58 to rotate in a circular orbit about the second rotational axis 88. The practical consequences of this constraint will be discussed hereafter.

In order to describe the contour of the internal chamber 14 of the housing 16, a brief synopsis of the operation of the rotary motor 10 is necessary. As shown in FIGS. 6 through 12, it is contemplated that the rotor 12 will move about the internal chamber 14 in such a way that all three lobes 36, 28 and 40 remain continuously in contact with the walls defining the internal chamber 14.

During operation of the rotary motor 10, the rotor 12 will rotate about its own rotor centroid 42 and will also follow an oval-shaped orbit about the internal chamber, with the rotor centroid 42 following the path shown in FIGS. 6 through 12. In order to convert this motion into useful work, it is contemplated that the motion of the rotor 12 will be converted into circular orbital movement of the circular converter member 58 about the second rotational axis 88, and rotation of the circular orbital converter 58 about the third rotational axis 62. This movement will then be used to drive rotation of the output shaft 20 by way of the rotary converter member 60.

Referring to FIG. 1, it will be recalled that the circular converter member 58 is constrained to move in a circular orbit about the second rotational axis 88, as discussed above. Given the necessary circular orbital movement of the circular converter member 58, the path followed by the rotor 12, which is engaged with the circular converter member 58, may be determined. The necessary path of the rotor 12 will in turn determine the shape of the internal chamber 14.

Figure 5:
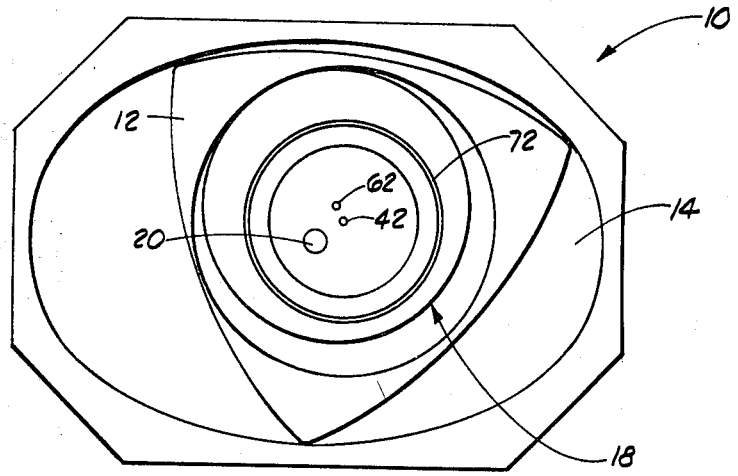
FIG. 5 is a cross-sectional view of the rotary motor shown in FIG. 4, in which the rotor has travelled through an angle $\alpha$ from the rotor position shown in FIG. 4.
Figure 13:
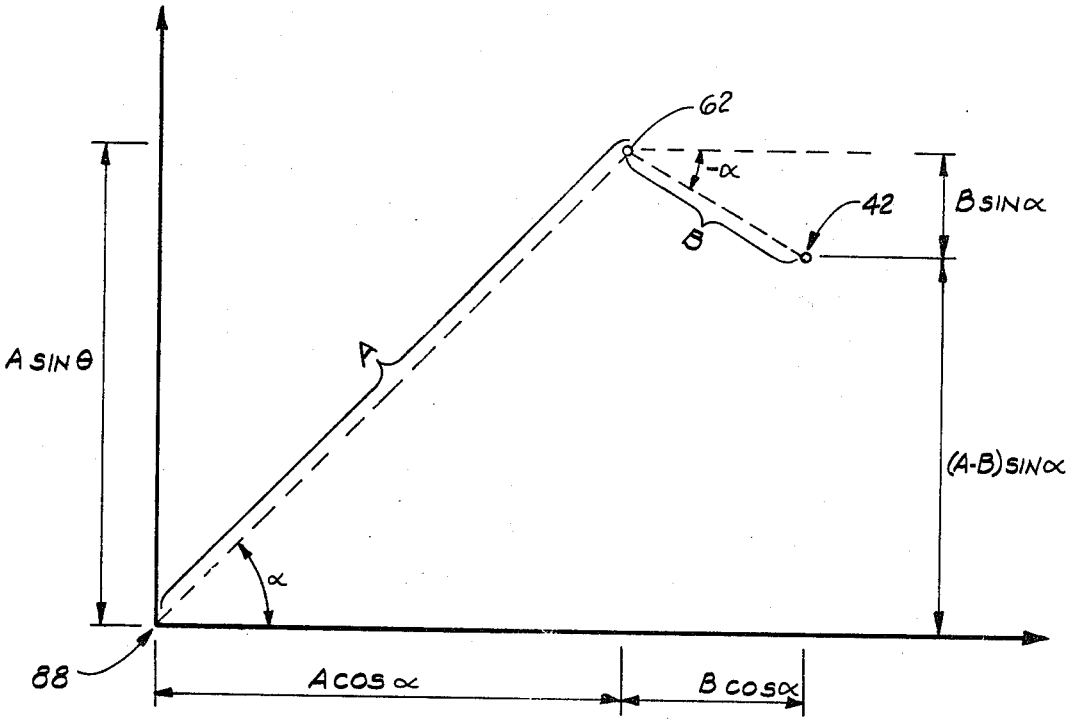
FIG. 13 is a detailed view of the geometrical relationships of the components of the rotary motor when the rotor is in the position shown in FIG. 5.

FIGS. 5 and 13 shows the configuration of the rotary motor 10 after the rotor centroid 42 has travelled through an arbitrary angle $\alpha$ from the position shown in FIG. 4. The angle $\alpha$ is measured with respect to any arbitrary x-axis with the z-axis taken as the second rotational axis 88.

Referring to FIG. 13, it will be noted that the bearing surface 72 is characterized by the property that the rotor centroid 42 moves through an angle $\alpha$ about the third rotational axis 62 in response to movement of the circular converter member 58 through an angle $\alpha$ about the first rotational axis. Given this, if the second rotational axis is regarded as the z-axis, these geometrical relationships require that the rotor centroid 42 follow the path:

$$x=(A+B)\cos\alpha$$

$$y=(A-B)\sin\alpha$$

In order to determine the shape of the internal chamber 14 the rate of rotation of the rotor 12 about its own axis, relative to its rate of orbital rotation, must be selected. Additionally, the initial position of the lobes of the rotor 12 must be chosen. For purposes of the preferred embodiment the third lobe 40 will be assumed to be disposed along the x-axis when $\alpha=0$; it should be understood, however, that other initial conditions could be selected.

For purposes of the preferred embodiment, the rotor 12 will be caused to rotate about its rotor centroid 42 at $\frac{1}{3}$ of the rate at which the third rotational axis 62 orbits about the internal chamber 14. Because the rotor 12 has three identical side surfaces, this constraint means that each complete orbital rotation of the rotor centroid 42 brings a new side surface into the same position occupied by the adjacent side surface one orbit before.

Figure 14:
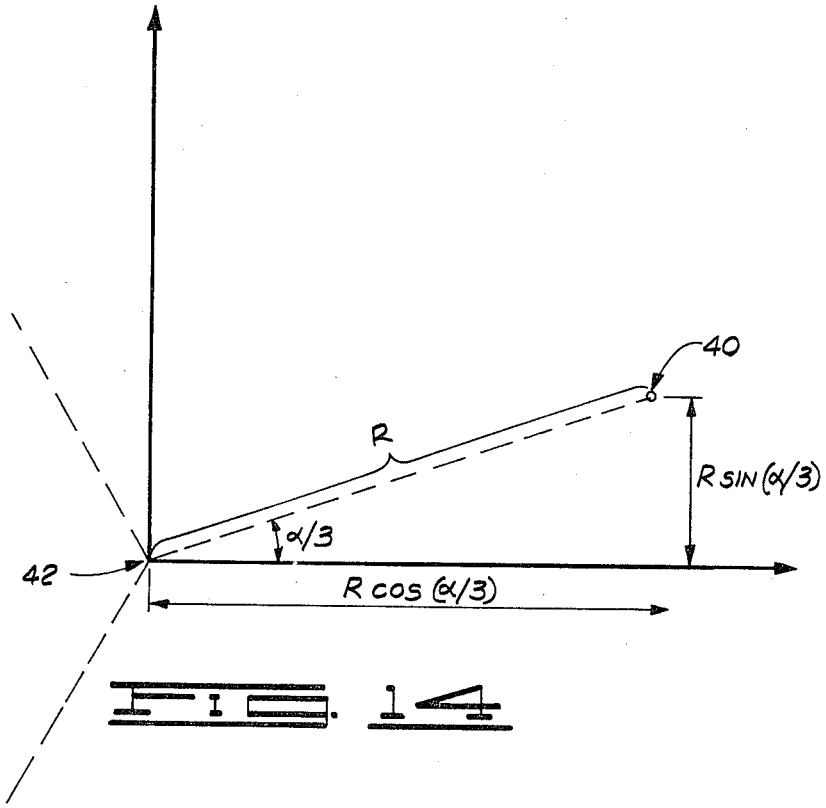
FIG. 14 shows the position of the rotor lobe 40 when it has rotated about the rotor centroid 42 by an angle $\alpha/3$.

By examining the geometry shown in FIG. 14, it will be appreciated that the constraints discussed above are such that the line connecting the rotor centroid 42 to the extremity of the third lobe 40 will travel through an angle $\alpha/3$ when the third rotational axis 62 travels through an angle $\alpha$ about the second rotational axis 88. In three orbital revolutions of the rotor centroid 42 about the axis 88, the third lobe 40 will trace out the contour of the internal chamber 14. The equations of the internal chamber 14 are therefore defined by adding the coordinates of the rotor centroid 42 to the coordinates of the third lobe 40 relative to the rotor centroid 42:

$$x=(A+B)\cos\alpha+R\cos(\alpha/3)$$

$$y=(A-B)\sin\alpha+R\sin(\alpha/3)$$

where $\alpha$ ranges between 0 and $6\pi$, the equivalent of 3 orbital revolutions of the rotor centroid 42.

With reference to FIGS. 6 through 12 the energy input assembly comprises a fuel inlet 110, providing a fluid communication between a source of air-fuel mixture (not shown) and the internal chamber 14. Further comprising the energy input assembly is an exhaust outlet 112, which provides fluid communication between the internal chamber 14 and an exhaust conduit (not shown). The inlet 110 and outlet 112 are preferably formed in the front wall 22 of the housing 16. If desired, an additional inlet-output pair may be formed in the opposite side of the internal chamber 14, in the back wall 24. The energy input assembly also comprises a spark plug 114 disposed to spark within the internal chamber 14 in a manner to be described hereafter.

Figure 6:
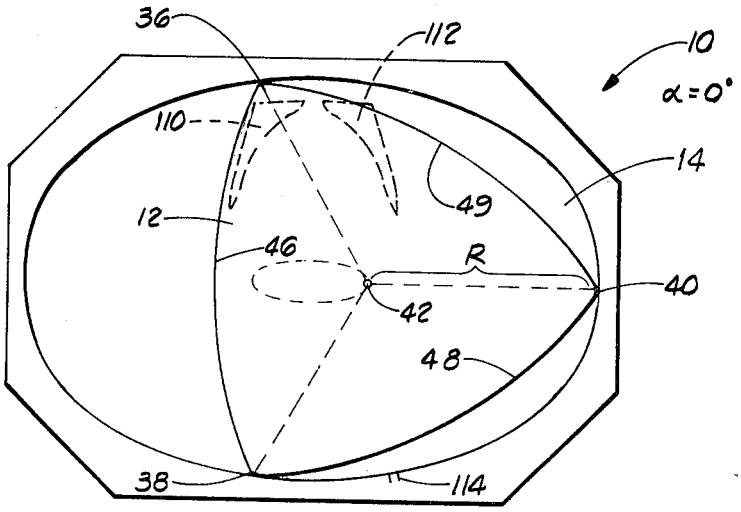
FIG. 6 is a semi-schematic cross-sectional view of the rotary motor, along line 4—4, showing the rotor position when $\alpha=0°$.

The operation of the energy input assembly may be understood by examining in series the movements of the rotor 12 about the internal chamber 14. In FIG. 6, the angle $\alpha=0°$ and the first face surface 28 of the rotor 12 is about to move, as the rotor 12 rotates in a counterclockwise direction, so as to uncover the fuel inlet 110 and place it in fluid communication with the internal chamber 14. After the the fuel inlet 110 is uncovered, air-fuel mixture is caused, by a conventional pumping apparatus, to enter the internal chamber 14, where it is confined by the third side surface of the rotor 12 and the walls of the internal chamber 14.

Figure 7:
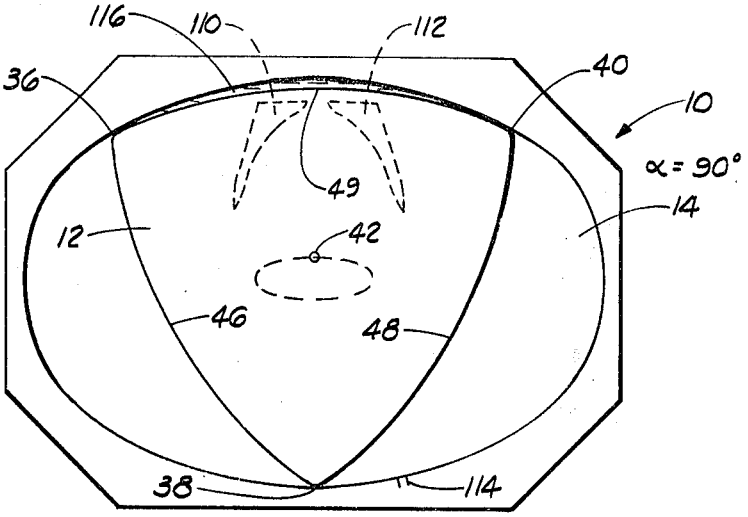
FIG. 7 is a semi-schematic, cross-sectional view of the rotary motor, along line 4—4, showing the rotor position when $\alpha=90°$.
Figure 8:
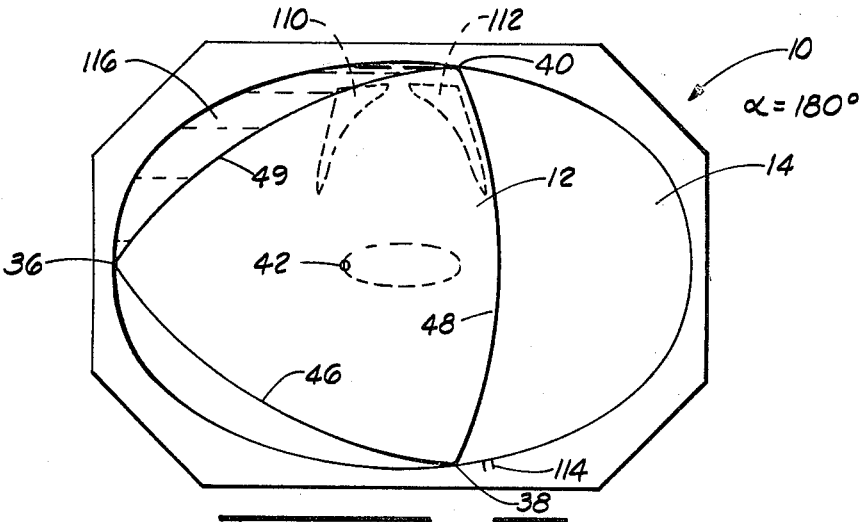
FIG. 8 is a semi-schematic cross-sectional view of the rotary motor along line 4—4, showing the rotor position when $\alpha=180°$.
Figure 9:
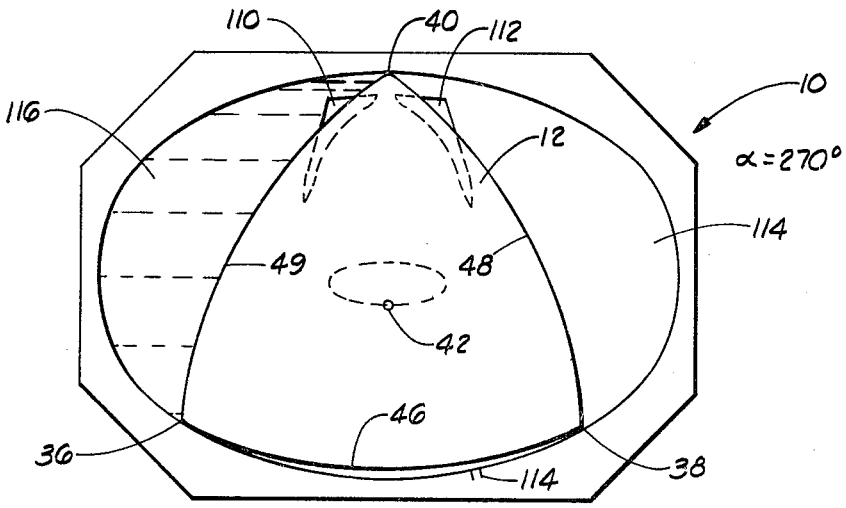
FIG. 9 is a semi-schematic cross-sectional view of the rotary motor along line 4—4, showing the rotor position when $\alpha=270°$.
Figure 10:
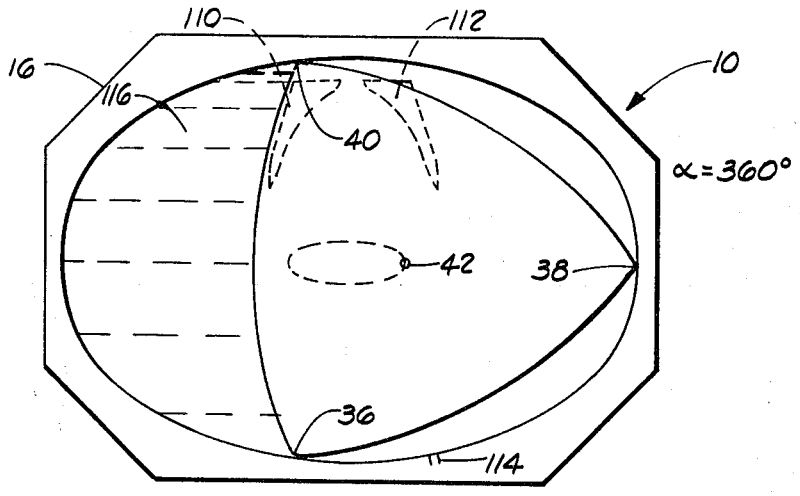
FIG. 10 is a semi-schematic cross-sectional view of the rotary motor along line 4—4 showing the rotor position when $\alpha=360°$.

In FIG. 7, the rotor 12 has travelled to the position where the angle $\alpha=90°$, and air-fuel mixture 116 is about to begin to fill the cavity defined by the third side surface of the rotor 12 and the walls of the internal chamber 17. FIGS. 8 and 9, show the rotor 12 at the angles $\alpha=180°$ and $\alpha=270°$ respectively, as the volume of the cavity, and the amount of fuel admitted thereto, increases. The volume of this cavity is at a maximum at $\alpha=360°$, as shown in FIG. 10.

Figure 11:
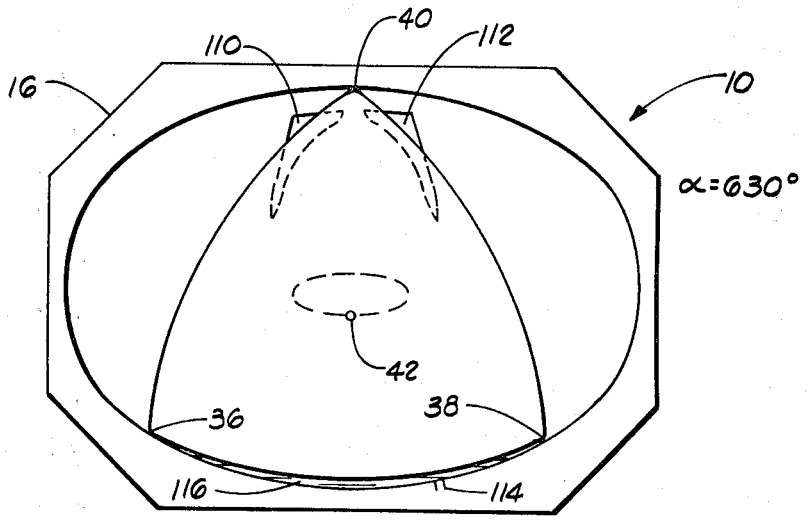
FIG. 11 is a semi-schematic cross-sectional view of the rotary motor along line 4—4, showing the rotor position when $\alpha=630°$.

As the rotor 12 continues to rotate in a counterclockwise direction, the inlet port 110 closes as the face surface 28 moves into overlying relation with the inlet ports; simultaneously the cavity defined by the third side surface 49 and the walls of the internal chamber 14 decreases in volume until an approximate minimum is reached at $\alpha=630°$, shown in FIG. 11. At this point the air-fuel mixture 116 previously admitted to the cavity is highly compressed. At least one spark plug 114 is activated at this point, causing the air-fuel mixture 116 to ignite and explosively expand, driving counterclockwise rotation of the rotor 12. Timing means are provided to actuate the spark plug 114 at appropriate intervals.

Figure 12:
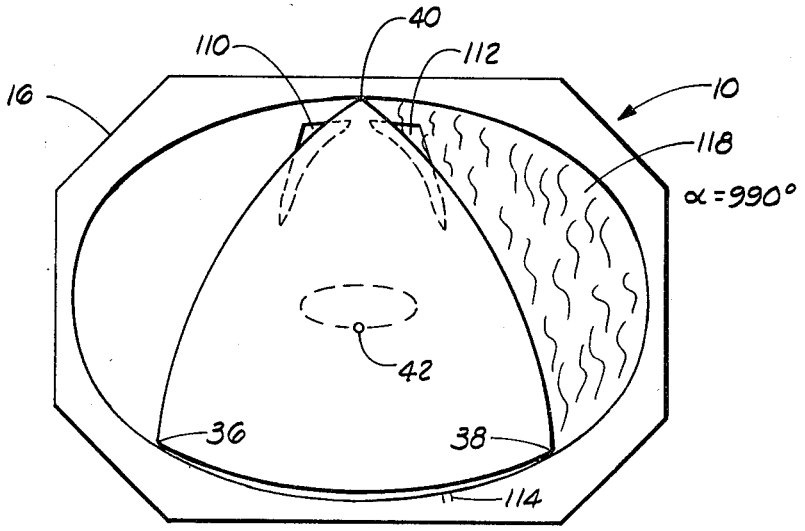
FIG. 12 is a semi-schematic cross-sectional view of the rotary motor along line 4—4, showing the rotor position when $\alpha=990°$.

As the rotor 12 continues to rotate in a counterclockwise direction, the first face surface 28 uncovers the exhaust outlet, 112 so as to place it in fluid communication with the internal chamber 14. The previously combusted air-fuel mixture, now shown as exhaust 118, may flow out of the internal chamber 14 through the exhaust outlet 112, as is shown in FIG. 12, where the angle $\alpha=990°$. As the rotor 12 continues to rotate, exhaust is eliminated from the cavity defined by the third side surface 49 and the walls of the internal chamber 14. At $\alpha=1080°$, after three complete rotations of the rotor centroid 42, the third lobe 40 has returned to the position shown in FIG. 6, and the exhaust outlet 112 has practically been closed with respect to the internal chamber 114 by movement of the first face surface 28 into overlying relation with the exhaust outlet 112. The cycle just described may then be repeated.

It will be noted that opening and closing of the fuel inlet 110 and exhaust outlet 112 is provided for by motion of the first face surface 28 with respect to the front wall 22 of the internal chamber 14. Unlike the case with conventional reciprocating internal combustion engines, there is no need for valves, valve trains or reciprocating parts. Further, it will be noted that each cavity defined by the side surfaces of the rotor 12 is out of fluid communication with the inlet 110 and outlet 112 while air-fuel mixture is being ignited in that cavity. Thus, there is no danger of leakage through the ports during combustion carried out in the rotary motor 10.

The operational sequence of the rotary motor 10 has just been described with reference to the cavity defined by the third side surface 49 and the walls of the internal chamber 14. However, it will be understood that at the same time, the same process is occurring with the cavities defined by the first side surface 46 and the second side surface 48. The sequence events involving the cavity defined by the first side surface 46 occur 360° ahead of the corresponding events in the cavity defined by the third side surface 49; the sequence events involving the second side surface 48 occur 360° behind the corresponding events involving the cavity defined by the third side surface 49.

For example, air-fuel mixture injected into the cavity defined by the first side surface 46 is at a maximum volume at $\alpha=0°$ (shown in FIG. 6), which is 360° ahead of the point when the maximum volume is reached for the cavity defined by the third side surface 49, at $\alpha=360°$ (shown in FIG. 10). Thus, it will be understood that there will be three ignitions of air-fuel mixture, and thus three power strokes, in the course of one rotation of the rotor 12 about its rotor centroid 42. Seals are provided for each of the lobes 36, 38 and 40, in order to separate the cavities defined by each pair of lobe extremities and the peripheral wall 26 of the internal chamber 14.

It will be noted that the cavity defined by each side surface of the rotor 12 reaches a maximum volume (such as the volume occupied by the fuel 116 in FIG. 10), which is greater than the maximum cavity volume possible with a rotor of the same size, in an epitrochoidal internal chamber of the type known in the prior art. The cavity simultaneously provides a relatively small surface area in relation to volume, which minimize dissipation of heat into the housing 16 and permits optimal use of the combustion cycle for production of useful work.

The rotary motor 10 of the present invention offers a better compression ratio, and thus better engine efficiency than prior art rotary engines employing an epitrochoidal internal chamber. Additionally, the compression ratio attainable with the rotary motor 10 may be tailored to any desired level, including a diesel compression ratio, by appropriate sizing of the side surfaces of the rotor 12. It will also be noted that the three power strokes during a single rotor rotation offers a marked advantage over conventional internal combustion engines, which offers only one power stroke for each pair of reciprocating engine motions.

As the rotor 12 is driven around the internal chamber 14 by successive ignitions of air-fuel mixture by the spark plug 114, the external gear track 78 and the bearing 72 constrain the rotor 12 so that the rotor centroid 12 follows the oval-shaped path shown in FIGS. 6 through 12. As previously discussed, this orbital movement of the rotor centroid 42 causes the circular converter member 58 to follow a circular orbit around the second rotational axis 88, which in turn drives the rotary converter member 60, by way of the bearing 86 and the internal gear track 76, to likewise rotate about the second rotational axis 88.

With reference to FIG. 2, counterclockwise orbital movement of the rotor 12 around the oval-shaped orbit, plus counterclockwise rotation of the rotor 12 about the rotor centroid 42, causes the rotor gear track 80 to travel in a counterclockwise direction. Because the rotor gear track 80 is tangentially engaged with the external gear track 78 of the circular converter member 58, this movement in turn drives the external gear track 78, and thus the integral internal gear track 78 in a clockwise direction. Because the internal gear track 78 is in turn tangentially engaged with the external gear track 90 of the rotary converter member 60, clockwise motion of the internal gear track 78 in turn drives counterclockwise motion of the external gear track 90, and thus drives counterclockwise rotation of the concentric section 81 and thus the coaxial output shaft 20. This rotational motion of the output shaft 20 may be conventionally be applied to produce useful work.

In order to determine the necessary gearing for the gear tracks 76, 78, 80 and 90, the radii of these gears will be designated respectively by the variables $R_{76}$, $R_{78}$, $R_{80}$ and $R_{90}$. With reference to FIGS. 1 and 2, the teeth of gear track 90 mesh with those of gear track 76, and the center of gear track 90 is symmetrical about the second rotational axis 88. The gear track 76 is symmetrical about the third rotational axis 62. Because the third rotational axis 62 is spaced by a distance A from the second rotational axis 88, this means that $R_{90}+A=R_{76}$.

The teeth of the gear track 78 mesh with the teeth of the gear track 80, and the center of the gear track 78 is symmetrical about the third rotational axis 62. The teeth of the gear track 80 are symmetrical about the first rotational axis 44. Because the third rotational axis 62 is spaced by a distance B from the first rotational axis 44, this means that $R_{78}+B=R_{80}$.

With continued reference to FIG. 2, movement of the rotor 12, and the rotor gear track 80, drives the external gear track 78 in motion characterized as the sum of two rotational components $\omega(a)$ and $\omega(b)$. The quantity $\omega(a)$ corresponds to the speed of the gear track 78 about the third rotational axis 62; the quantity $\omega(b)$ corresponds to the rotational speed of the third rotational axis 62 about the first rotational axis 44, which occurs as the gear track 78 rolls around the inside of the gear track 80.

The value of $\omega(a)$ may be calculated by use of the conventional relationship between gear size and gear speed for stationary meshed gears:

$$\frac{\omega_{80}}{\omega(a)} = \frac{R_{78}}{R_{80}} \quad \text{so that } \omega(a) = \omega_{80}\left(\frac{R_{80}}{R_{78}}\right).$$

When gear track 78 rolls around the gear track 80 one time the gear track 78 will have rotated about its own axis by $$\left(\frac{R_{80}}{R_{78}} - 1\right)$$

revolutions.

The rotor 12 is rotating at $\frac{1}{3}$ the angular speed of output shaft 20 and external gear track 90; the gear track 78 rolls around the rotor gear track 80 at the same rotational speed as that of the external gear track 90. Therefore, the gear track 78 rolls around the external gear track 80 three times for each revolution of the rotor 12. Accordingly, $$\frac{\omega(b)}{\omega_{80}} = 3\left(\frac{R_{80}}{R_{78}} - 1\right).$$

Because $\omega_{78}=\omega(a)+\omega(b)$, therefore:

$$\omega_{78} = \omega_{80}\left(\frac{4R_{80}}{R_{78}} - 3\right).$$

Because the gear track 78 is integral with the gear track 76, the two tracks therefore have the same angular velocity. Therefore:

$$\omega_{76} = \omega_{80}\left(\frac{4R_{80}}{R_{78}} - 3\right).$$

Gear track 90 is driven in a counterclockwise direction by gear track 76, which is characterized by angular velocity $\omega_{76}$. The quantity $\omega_{76}$ is the sum of the components $\omega(c)$ and $\omega(d)$. The quantity $\omega(c)$ corresponds to the rotational speed of gear track 76 around the third rotational axis 62. The quantity $\omega(d)$ corresponds to the rotational speed at which the gear track 76 rolls around the gear track 90 (in a clockwise direction), while rotating about the first rotational axis 44.

Applying the conventional gear ratio relationship for meshed gears:

$$\frac{\omega(c)}{\omega_{90}} = \frac{R_{90}}{R_{76}}$$

$$\text{so that } \omega(c) = \omega_{90}\frac{R_{90}}{R_{76}}.$$

$$\text{Similarly, } \omega(d) = \omega_{90}\left(\frac{R_{90}}{R_{76}} - 1\right).$$

$$\text{Therefore } \omega_{76} = \omega(c) + \omega(d) = \omega_{90}\left(\frac{2R_{90}}{R_{76}} - 1\right).$$

Because gear track 90 makes three rotations for each single rotation of gear track 78, therefore $\omega_{90}=3\ \omega_{76}$.

$$\text{or: } 3\left(\frac{2R_{90}}{R_{76}} - 1\right) = \omega_{76}$$

Equating $\omega_{76}$ to $\omega_{78}$, because the respective gear tracks 76 and 78 are coaxial and integral, therefore:

$$\frac{4R_{80}}{R_{78}} - 3 = \frac{6R_{90}}{R_{76}} - 3 \quad \text{or} \quad \frac{2R_{80}}{R_{78}} = \frac{3R_{90}}{R_{76}}$$

By use of this equation, together with the previously derived relationships:

$$R_{78}+B=R_{80}$$

$$R_{90}+A=R_{76}$$

the relative sizes of the gear tracks may be derived.

If R=40, A=6 and B=2, then $$R_{78}+2=R_{80}$$

$$R_{90}+6=R_{76}$$

Setting $R_{80}=30$, then $R_{78}=28$; therefore, $$2\cdot\frac{R_{80}}{R_{78}} = 2\cdot\frac{30}{28} = \frac{60}{28} = 3\cdot\frac{R_{90}}{R_{76}}$$

Therefore, $$\frac{R_{90}}{R_{76}} = \frac{5}{7};$$

but since $R_{90}+6=R_{76}$ therefore, $R_{90}=15$ and $R_{76}=21$. Therefore, $$R_{80}=30$$

$$R_{78}=28$$

$$R_{76}=21$$

$$R_{90}=15.$$

The number of teeth in each gear will be proportional to the radii stated above. It should be understood that the foregoing values of A, B and R and $R_{80}$ have been selected for purposes of example, and that the present invention may be practiced over a range of values for these constants.

While a rotary engine having an internal chamber defined by the equations, $$x=(A+B)\cos\alpha+R\cos(\alpha/3)$$

$$y=(A-B)\sin\alpha+R\sin(\alpha/3)$$

and a three-lobed rotor, represent the preferred embodiment it should be noted that the present invention is not limited to a three-lobed rotor, or to the particular internal chamber shape suitable for use with such a three-lobed rotor. More generally, in accordance with the present invention, a rotor may feature M lobes, where M is an integer greater than or equal to 2. When the lobes are interconnected, they will form an equilateral polygon of M sides, if M is greater than 2, or a straight line if M equals 2. With such a rotor, the internal chamber will be defined by the equations:

$$x=(A+B)\cos\alpha+R\cos(\alpha/M)$$

$$y=(A-B)\sin\alpha+R\sin(\alpha/M)$$

Where $\alpha$ ranges between 0 and $2\pi M$ radians, and where A, B and R are arbitrary constants.

Figure 16:
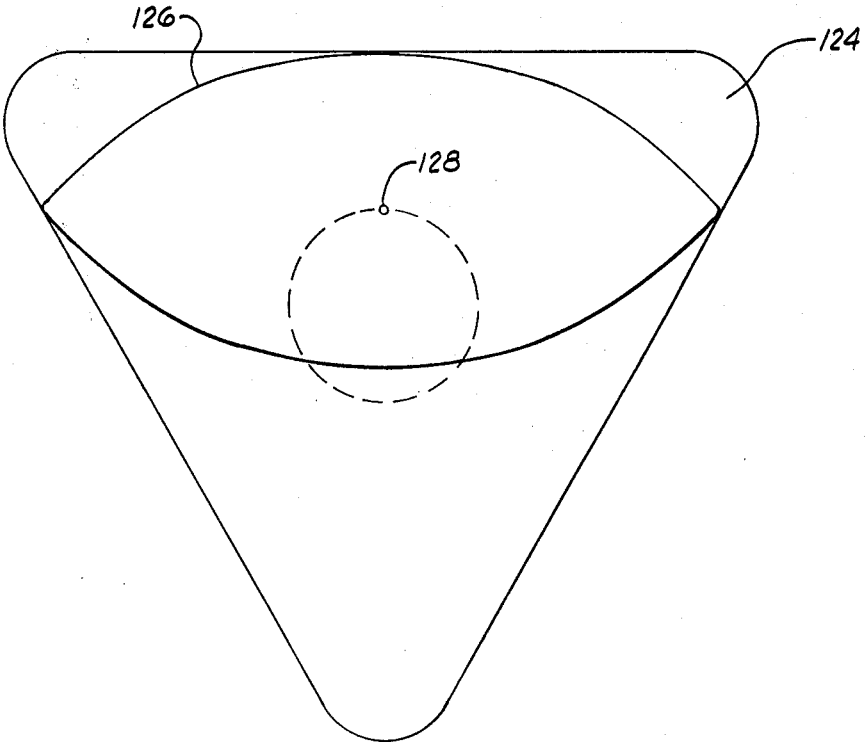
FIG. 16 is a semi-schematic, cross-sectional view of the rotary motor of the present invention, showing another type of internal chamber shape.

The foregoing internal shape is based on the constraint that the rotor centroid travels around the housing in the same direction that the rotor rotates about its centroid. However, it should be understood that another family of internal chamber shapes, suitable for use in practicing the present invention, may be derived by prescribing that the rotor centroid travels around the internal chamber in a direction opposite to the direction of rotation of the rotor about its centroid. In this event, the pertinent equations for the internal chamber would be:

$$x=(A+B)\cos\alpha+R\cos(\alpha/M)$$

$$y=(A-B)\sin\alpha-R\sin(\alpha/M)$$

where $\alpha$ ranges between 0 and $2\pi M$ radius, and where A,B and R are arbitrary constants. The characteristic shape of such an internal chamber 124, having three lobes, is shown in FIG. 16. A two-lobed rotor 126 is utilized with such an internal chamber shape. In the embodiment shown in FIG. 16, the rotor centroid 128 travels around a path which consists of a circle.

The operation and construction of the output shaft, energy input assembly and orbital coupling assembly employed in such a generalized rotor and internal chamber shape are the same as that previously described with reference to the three-lobed rotor, and will not be repeated.

Changes may be made in the construction and operation of the various parts, elements and assemblies described herein without departing from the spirit and scope of the invention as described in the following claims.

What is claimed is:

1. A rotary motor comprising:

a housing having an internal chamber, the chamber surface being defined cross-sectionally by the equations $$x=(A+B)\cos\alpha+R\cos(\alpha/M)$$

$$y+(A-B)\sin\alpha+KR\sin(\alpha/M)$$

where $\alpha$ is an angle ranging between 0 and $2\pi M$ radians where A, B and R are arbitrary constants, where M is an integer greater than or equal to 2, and where K is a number selected from the set consisting of $+1$ and $-1$;

a rotor disposed within the internal chamber of the housing, the rotor having M lobes, each lobe contacting the chamber surface, with the lobe extremities defining vertices of an equilateral polygon when M is greater than 2, and extremities of a straight line when M equals 2, the polygon and straight line having a circumscribed circle of radius R, having a centroid defining a first rotational axis extending through the rotor and parallel to the z-axis and having a converter engagement surface coaxial with the first rotational axis;

an output shaft fixedly supported by the housing and having a second rotational axis coextensive with the z-axis;

energy input means for powering movement of the rotor around the internal chamber surface in a selected orbital direction and parallel to the xy plane and for powering simultaneous rotational movement of the rotor about its first rotational axis; and orbital coupling means operatively engaged with the rotor, for driving rotational movement of the output shaft in response to orbital movement of the rotor and rotational movement of the rotor about the first rotational axis, the orbital coupling means comprising:

a circular converter member, slidingly engaged with the converter engagement surface of the rotor and having a third rotational axis offset from the first rotational axis by the distance B, the circular converter member movable in a combination of circular orbital movement and rotary movement about the third rotational axis in response to movement of the rotor; and a rotary converter member, engaged with the circular converter member for driving rotation of the output shaft about the second rotational axis in response to movement of the circular converter member.

2. The apparatus of claim 1 in which $K=+1$.

3. The apparatus of claim 1 in which $K=-1$.

4. A rotary motor comprising:

a housing having an internal chamber, the chamber surface being defined cross-sectionally by the equations $$x=(A+B)\cos\alpha+R\cos(\alpha/3)$$

$$y=(A-B)\sin\alpha+R\sin(\alpha/3)$$

where $\alpha$ is an angle ranging between 0 and $6\pi$ radians and where A, B and R are arbitrary constants;

a rotor disposed within the internal chamber of the housing, the rotor having three lobes, each lobe contacting the chamber surface, with the three lobe extremities defining vertices of an equilateral triangle having a circumscribed circle of radius R, having a centroid defining a first rotational axis extending through the rotor and parallel to the z-axis and having a converter engagement surface coaxial with the first rotational axis;

an output shaft fixedly supported by the housing and having a second rotational axis coextensive with the z-axis;

energy input means for powering movement of the rotor around the internal chamber surface in a selected orbital direction and parallel to the xy plane and for powering simultaneous rotational movement of the rotor about its first rotational axis; and orbital coupling means operatively engaged with the rotor, for driving rotational movement of the output shaft in response to orbital movement of the rotor and rotational movement of the rotor about the first rotational axis, the orbital coupling means comprising:

a circular converter member, slidingly engaged with the converter engagement surface of the rotor and having a third rotational axis offset from the first rotational axis by the distance B, the circular converter member movable in a combination of circular orbital movement and rotary movement about the third rotational axis in response to movement of the rotor; and a rotary converter member, engaged with the circular converter member for driving rotation of the output shaft about the second rotational axis in response to movement of the circular converter member.

5. The apparatus of claim 1 in which the circular converter member is characterized as having a converter engagement surface coaxial with the third rotational axis, and in which the rotary converter member slidingly engages the converter engagement surface of the circular conversion member and in which the second rotational axis is offset from the third rotational axis by distance A.

6. The apparatus of claim 5 in which the rotary converter member is further characterized as comprising a cylindrical member symmetrical about the third rotational axis, with the output shaft eccentrically engaged to the rotary converter member at a distance A from the third rotational axis.

7. The apparatus of claim 6 in which the output shaft is integral with the rotary converter member.

8. The apparatus of claim 7 in which the rotor is characterized as having an interior cavity and in which the circular converter member and the rotary converter member are received within the interior cavity of the rotor.

9. The apparatus of claim 8 in which the rotor is characterized as having internal gearing coaxial to the first rotational axis, and in which the rotary converter member is characterized as having external gearing coaxial to the second rotational axis, and in which coaxial gears are rotatably supported on the circular converter member for drivingly coupling the gears of the rotor to those of the rotary converter member.

10. The apparatus of claim 4 in which the rotor is characterized as forming three cavities with respect to the internal chamber, and in which the energy input means comprises:

an inlet port formed in the housing and fluidly communicating with a source of air-fuel mixture; and an exhaust port;

in which the inlet port opens and closes with respect to a given cavity during one phase of the rotational cycle of the rotor, and in which the exhaust port opens and closes with respect to the same cavity during a separate phase of the rotational cycle of the rotor.

11. The apparatus of claim 10 in which the energy input means further comprises:

spark means for igniting air-fuel mixture in a given cavity during a rotational phase of the rotor intermediate to the closing of the inlet port and the opening of the exhaust port with respect to the cavity.

12. The apparatus of claim 11 in which the opening of the inlet port is characterized as substantially contemporaneous with the closing of the outlet port with respect to a given cavity.

13. The apparatus of claim 10 in which the housing is characterized as having parallel side walls and in which the rotor is characterized as having parallel face surfaces clearingly adjacent each side wall, and in which the inlet and outlet ports are opened by movement of a face surface out of overlying relation to such ports, and in which the inlet and outlet ports are closed by movement of a face surface into overlying relation to such ports.

* * * * *